United States Patent [19]

Jentoft et al.

[11] 4,208,840

[45] Jun. 24, 1980

[54] SAFETY VENT

[75] Inventors: Arthur P. Jentoft, Kennebunkport; Paul A. Couture, Emery Mills, both of Me.

[73] Assignee: Wasco Products, Inc., Sanford, Me.

[21] Appl. No.: 949,637

[22] Filed: Oct. 10, 1978

Related U.S. Application Data

[63] Continuation of Ser. No. 799,224, May 23, 1977, abandoned.

[51] Int. Cl.[2] ..... E05F 1/00

[52] U.S. Cl. ..... 49/379; 49/386; 49/394; 292/201; 292/341.17

[58] Field of Search ..... 49/379, 386, 394; 292/341.17, 201

[56] References Cited

U.S. PATENT DOCUMENTS

| | | | |
|---|---|---|---|
| 1,180,814 | 4/1916 | Ziganek | 292/341.17 X |
| 2,047,401 | 7/1936 | Whitted | 49/379 X |
| 2,604,789 | 7/1952 | Derby et al. | 40/379 X |
| 2;800,348 | 7/1957 | Parsley | 49/379 X |
| 3,045,464 | 7/1962 | Braginetz | 292/341.17 X |
| 3,399,500 | 9/1968 | Shapiro | 49/379 X |
| 3,792,556 | 2/1974 | Anghinetti et al. | 49/379 X |
| 3,903,661 | 9/1975 | Gobel | 49/386 X |
| 3,964,207 | 6/1976 | Peterson | 49/394 X |

*Primary Examiner*—Philip C. Kannan
*Attorney, Agent, or Firm*—Wolf, Greenfield & Sacks

[57] ABSTRACT

A safety vent preferably for use in a high rise building for permitting the escape of smoke and fumes and comprising a fixed frame accommodated by an opening in the building, a movable frame pivotally secured to the fixed frame and means for biasing the movable frame to an open position. In the preferred embodiment the movable frame includes panel means and pivots at its lower end. A latch mechanism maintains the movable frame in a closed position while a release mechanism, operated either electrically or pneumatically, can be energized to permit opening of the vent. Limiting means in the form of shock absorbers or snubbers interconnect between frames for limiting the open position of the vent.

15 Claims, 14 Drawing Figures

SAFETY VENT

This is a continuation of application Ser. No. 799,224, filed May 23, 1977, now abandoned.

FIELD AND BACKGROUND OF THE INVENTION

The present invention relates in general to a vent for use in a building for venting a fire within the building. More particularly, the present invention is concerned with a pivotal wall vent preferably pivoted along its lower border that is normally secured in a closed position but that is readily releasable preferably either pneumatically or electrically so as to assume an open position for venting a fire within the building.

U.S. Pat. No. 3,516,210, assigned to the assignee of the present application, shows a fire vent, and discloses the general use and operation of this vent. This vent operates satisfactorily; it being the objective of the present invention, however, to provide certain improvements in this structure.

Accordingly, an object of the present invention is to provide a fire vent that is releasably maintained in a closed position and that can be quickly and reliably released to an open position for venting a fire within a building.

A further object of the present invention is to provide a fire vent comprising a fixed frame and a movable frame that is normally retained in a closed position but which may be either electrically or pneumatically released.

A further object of the present invention is to provide a fire vent that can be readily released from any remote position from within the building.

Another object of the present invention is to provide a fire vent which is relatively simple in construction including positive latching means in combination with reliable release means.

Another object of the present invention is to provide a latching structure that also serves the function of transferring wind loads from the movable frame to the fixed frame.

SUMMARY OF THE INVENTION

To accomplish the foregoing and other objects of this invention there is provided a vent for a building for venting a fire that may occur in the building. This vent comprises a fixed frame, a movable frame adapted to fit within the fixed frame when in a closed position, means for pivotally securing the frames in interconnecting relationship, means for urging the movable frame to an open position, latch means for maintaining the movable frame in a closed position and means for releasing the latch means to permit the movable frame to move to its open position.

In the disclosed embodiment the movable frame pivots at its bottom edge and there are provided two latches and associated releases one being disposed on either side of the vent. Each latch comprises a latch member or trigger member and an associated latch bar for releasing the latch member or trigger member. The end of the latch bar is maintained in a biased condition by means of a release plate. The release mechanism may be either of the electrical type or may be pneumatically operated. In accordance with the invention there is also preferably provided limiting means in the form of a pair of shock absorbers suitably secured at either side of the frame for permitting an easy and gradual opening of the movable frame and yet limiting the open position thereof.

BRIEF DESCRIPTION OF THE DRAWINGS

Numerous other objects, features, and advantages of the invention should now become apparent upon a reading of the following detailed description taken in conjunction with the accompanying drawings, in which.

DETAILED DESCRIPTION

Figure 9:
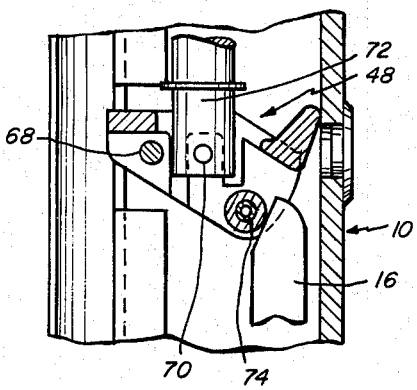
FIG. 9 is a cross-sectional view taken along line 9—9 of FIG. 8.
Figure 10:
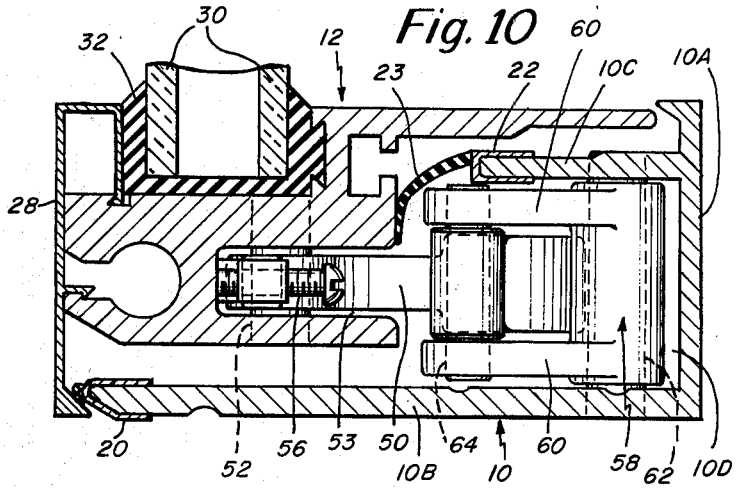
FIG. 10 is a cross-sectional view taken along line 10—10 of FIG. 7 showing additional detail for the latch mechanism.
Figure 11:
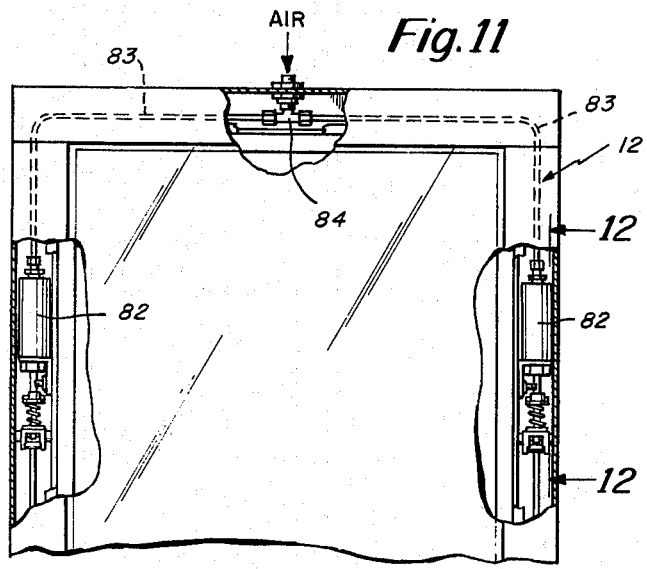
FIG. 11 is a partial front elevational view partially cut away for an alternate embodiment of the present invention using pneumatic actuation.
Figure 12:
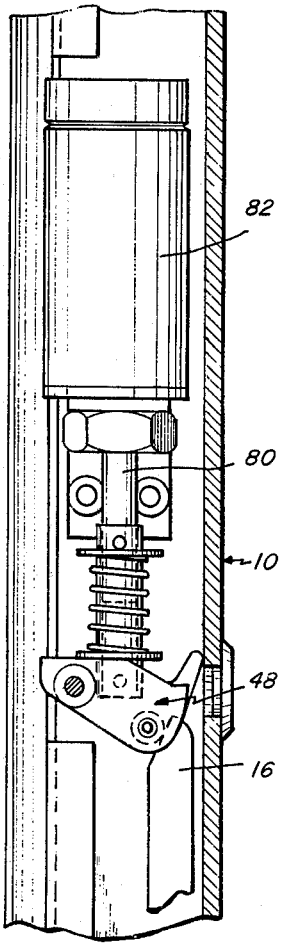
FIG. 12 is a cross-sectional view taken along line 12—12 of FIG. 11.
Figure 13:
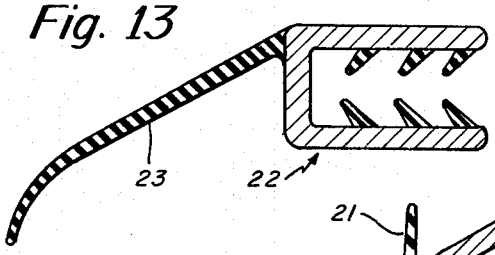
FIG. 13 shows one sealing gasket used with the vent of this invention.
Figure 14:
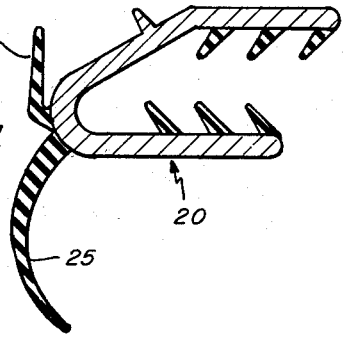
FIG. 14 shows the construction of another sealing gasket used with the vent of this invention.

Referring now to the drawings, there are disclosed two embodiments of the invention which are substantially similar in construction. The first embodiment is shown in FIGS. 1-10, while variations of the second embodiment are shown in FIGS. 11 and 12. FIGS. 13 and 14 show gaskets associated with the safety vent usable in both embodiments.

Figure 1:
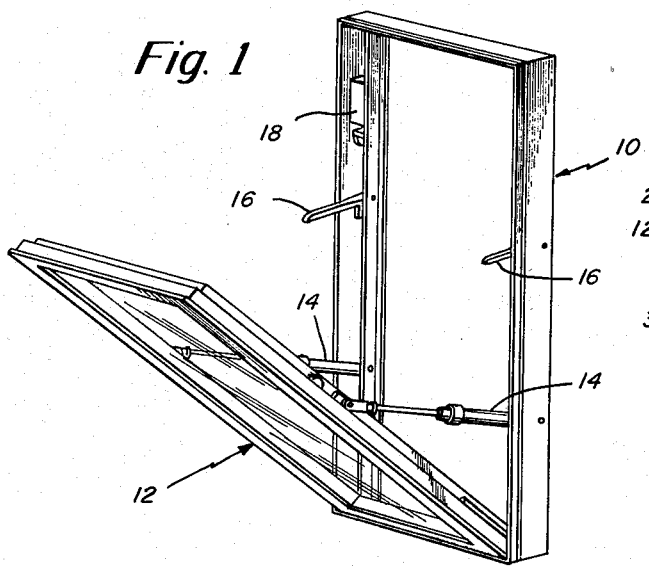
FIG. 1 is a perspective view of one embodiment of the vent of this invention shown in its open position.
Figure 6:
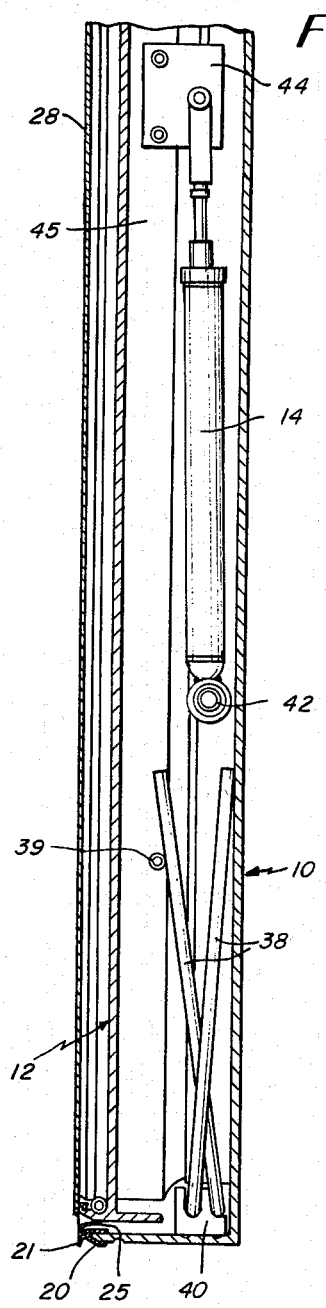
FIG. 6 is a cross-sectional view taken along line 6—6 of FIG. 2.

The general construction of the safety vent of this invention is shown in FIG. 1 and comprises fixed frame 10 and movable frame 12 which is pivotally interconnected to the fixed frame 10 along a lower edge thereof as shown and discussed in more detail hereinafter with reference to FIG. 6. A pair of shock absorbers 14 limit the open position of the movable frame 12 to a position substantially as shown in FIG. 1. The movable frame 12 is maintained in a closed position by means of a latching mechanism, including the latch bars 16 shown in FIG. 1. A release mechanism 18 is used to release the movable frame to the position shown in FIG. 1. This release mechanism in one embodiment comprises an electrically operated solenoid and in the second embodiment comprises a pneumatically operated piston.

Figure 3:
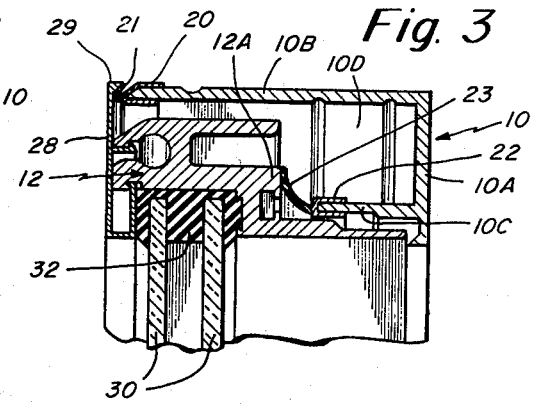
FIG. 3 is a cross-sectional view taken along line 3—3 of FIG. 2.
Figure 4:
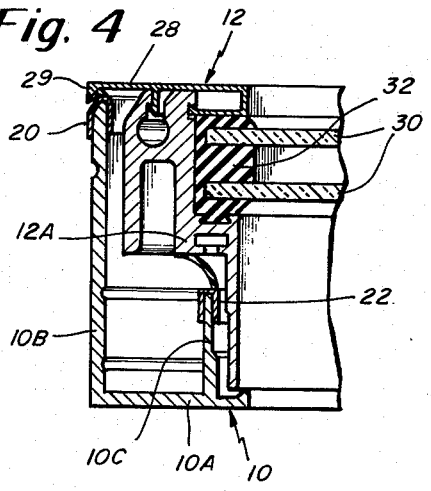
FIG. 4 is a cross-sectional view taken along line 4—4 of FIG. 2.
Figure 2:
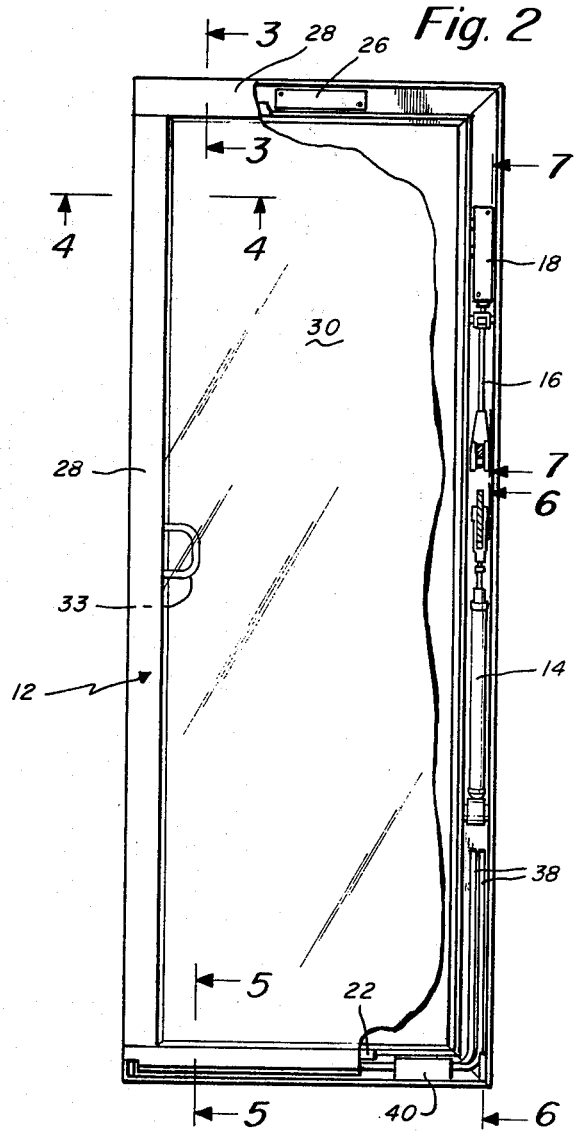
FIG. 2 is a front elevational view partially cut away to show some of the detail of the mechanisms associated with the vent of FIG. 1.
Figure 5:
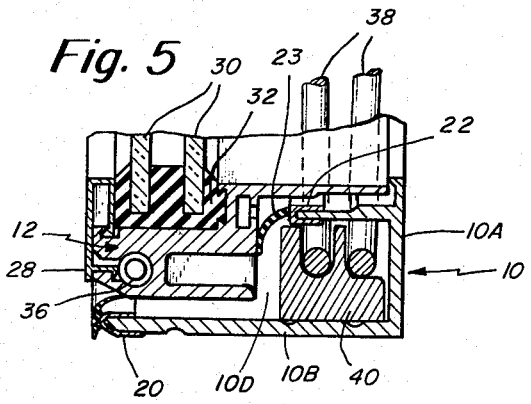
FIG. 5 is a cross-sectional view taken along line 5—5 of FIG. 2.

FIGS. 3 and 4 are cross-sectional views taken along lines 3—3 and 4—4, respectively of FIG. 2. These two cross-sectional views show the basic construction of the fixed frame and movable frame. Both frames may be constructed of an extruded aluminum.

The fixed frame may be secured in a window opening in any suitable manner such as with the use of screws and comprises frame base 10A, leg 10B, and leg 10C. An elongated rubber gasket 20 having a tail 21 is secured to the end of leg 10B. Similarly, another gasket 22 with its tail 23 is secured to the end of shorter leg 10C. These gaskets extend about the entire frame and provide sealing between the fixed and movable frames. Enlarged views of the gaskets 20 and 22 are shown respectively in FIGS. 14 and 13. The gasket shown in FIG. 14 does differ somewhat from the one shown in FIGS. 3 and 4 in that the tail 25 of this gasket has been removed along the portion that extends about the top and sides of the fixed frame. The tail 25 is maintained on the gasket 20 about the bottom of the fixed frame as shown in FIG. 6.

The fixed frame is constructed with a substantial space between the legs 10B and 10C so as to provide a space 10D which will easily accommodate the mechanism as shown in FIG. 2 including the shock absorber 14 and the latch and release mechanisms. Also, at the top of the vent there is provided an electrical box assembly 26 suitably secured within the space 10D. Electrical wiring connects to the box 26 and also to the release solenoids 18.

The movable frame 12 may also be constructed of an aluminum extrusion that is substantially the same for each side of the frame. The movable frame 12 has a shoulder 12A against which the tail 23 contacts when the movable frame is in its closed position. A facing strip 28 is snap-fitted with the movable frame and is used for the purpose of holding the panels 30 in position. The panels 30 are secured at their periphery in the mounting member 32. Replacement of the panels 30 can easily be facilitated by removal of the snapped-in facing strip 28. Also, the facing strip 28 terminates at end 29 forming a seal with the tail 21 of gasket 20. The movable frame may also be provided with handles 33 for facilitating closing of the movable frame and associated panels.

As previously mentioned, the safety vent disclosed herein preferably hinges at the bottom by means of a horizontally arranged hinge pin 36 accommodated by an elongated passage in the movable frame and secured at its ends to the fixed frame. The movable frame is also biased by means of a tortioning arrangement to an open position. To accomplish this there is provided a pair of tortion bars 38 shown in FIGS. 2, 5 and 6. In this connection see U.S. Pat. No. 3,516,210 for further details of the operation of the torsion members. FIG. 6 shows a stud 39 on the movable frame against which one of the tortion bars 38 is urged when the movable frame is in its closed position as shown in FIG. 6. If the movable frame is released the tension from the tortion bars 38 urges the stud 39 and in turn the entire movable frame to an open position. There are, of course, ends of the tortion bars 38 extending upwardly on both sides of the frame and also a pair of studs 39 disposed on opposite sides of the frame. The tortion bars 38 are fixed at their bottom ends in the tortion bar retainers 40 which are suitably secured to the fixed frame 10.

The shock absorbers 14 may be of conventional design and interconnect at one end by means of pin 42 to the fixed frame. The pin 42 bridges across the space 10D. The other end of the shock absorber 14 connects to a support plate 44 which is suitably secured to the leg 45 of the movable frame 12. When the movable frame is released to its open position the shock absorbers 14 function as limiting means for limiting the final open position of the movable frame.

Figure 7:
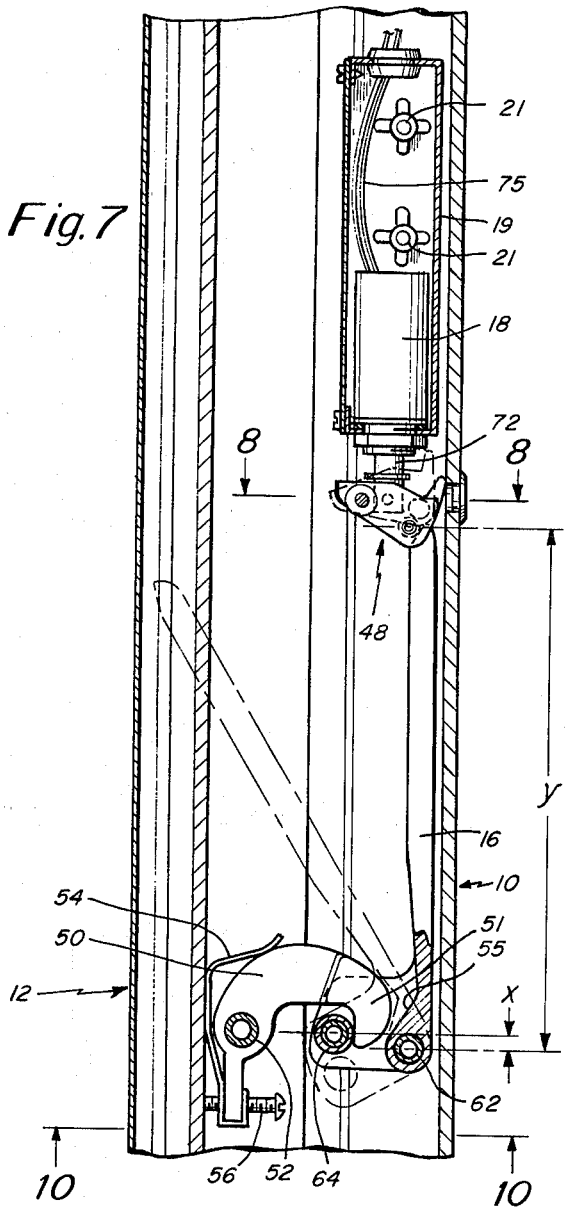
FIG. 7 is a somewhat enlarged cross-sectional view taken along line 7—7 of FIG. 2.

The movable frame is maintained in a closed position by means of a combination of interaction of the latch bar 16, release plate 48 and latch 50. The latch 50 has a C-shape or hook shape and is attached to the movable frame by means of the pin 52. The latch 50 is biased in a clockwise direction as viewed in FIG. 7 by means of the spring 54. The spring 54 has its free end contacting the latch 50 and is secured to the latch 50 below the pin 52 by means of the securing and adjusting screw 56 as depicted in FIGS. 7 and 10. The adjusting screw 56 may be adjusted inwardly urging against the movable frame 12 in the recess 53 therein vary the tension of spring 54 on the latch 50 and thus the position of the latch 50 relative to the latch bar 16.

The latch bar 16 terminates at its bottom end in a base 58 having walls 60 spaced from one another and extending therefrom as shown in FIG. 10. The base 58 is attached to the fixed frame by means of a spring pin 62 so that the latch bar is supported within the space 10D between the walls 10C and 10B comprising the fixed frame. In the closed position of the vent as shown in FIG. 7 the latch 50 is secured about pin 64 which is securely supported between the legs 60 of the latch bar. The end 51 of the latch 50 fits between the pins 62 and 64 with very little tolerance as shown in FIG. 7. The base 58 is provided with a shoulder 55 against which the end 51 of the latch may be urged. This action occurs when there are wind loads on the movable frame and panels. When this occurs the latch 50 is urged against the shoulder 55 and thus transfers the load through the latch to the fixed frame. Under these conditions the spring 54 maintains this load and the latch 50 may pivot slightly in a counterclockwise direction. This pivoting, however, is not sufficient to disengage the latch from the pin 64 unless the latch bar 16 is released.

The axes of the pins 62 and 64 are offset as most clearly shown in FIG. 7 by a vertical distance x. This eccentric arrangement is provided to cause a force through the latch 50 to permit rotation of the bar 16 through a relatively small angle sufficient to disengage the latch bar from the latch 50 when the release mechanism is actuated. FIG. 7 shows the latch bar 16 in solid and also shows in phantom the release position of the latch bar with the pin 64 disengaged from the latch 50. When this occurs the tortion members 38 urge the window to an open position.

Figure 8:
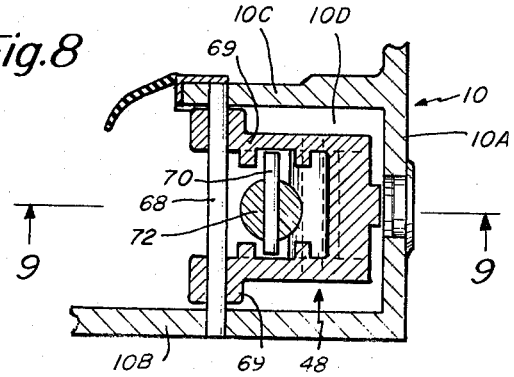
FIG. 8 is a cross-sectional view taken along line 8—8 of FIG. 7 in the vicinity of the release mechanism.

The latch bar 16 is maintained in its latched position by means of the release plate 48. Details of the latch bar plate 48 are shown in FIGS. 8 and 9. The plate 48 is secured to the fixed frame by means of the pivot pin 68 passing through legs 69 of the release plate 48. A further pin 70 is secured between the legs 69 in a fashion shown in FIG. 8 for connecting the plunger 72 of the solenoid 18 to the release plate 48. As shown in FIG. 9 a further pin 74 and its associated bushing are supported by the release plate 48 and are positioned to engage with the end of the latch bar as shown in FIG. 9. It is noted from the diagram of FIG. 9 that the release plate 48 need be rotated only a very slight distance in order to release the latch bar 16. The force conveyed through the latch 50 then automatically rotates the latch bar 16 in a counterclockwise direction as viewed in FIG. 7. The force at the point of contact between the latch bar 16 and the pin 74 is quite small and is in the ratio of the distance x to the distance y times the force imposed by the latch 50 on the latch bar. Thus, the latching mechanism is positive in action and yet requires only slight movement of the release mechanism to operate the vent to an open position. Furthermore, as previously mentioned wind forces on the outer frame are conveyed to the inner frame via the latches 50 on either side of the frames to transfer these forces to the fixed inner frame.

In addition to the direct wind force on the vent there is a suction force that is one of the most difficult forces for a movable frame to withstand. When there is a 30 lb. per sq. ft. wind suction on the movable frame, there are total forces of 1000 lbs. or more depending upon the window area which has to be carried from the movable frame through the latch 50 to the fixed frame. With these suction forces the movable frame which extends beyond the latch acts as a cantilever beam bending as the load is being carried to the latch. It has been found that with the latch structure of the present invention wind suction loads can be withstood which exceed by 2½ times that which would normally be expected on a vent unit. Also, even when there is a substantial wind suction force, the latch will open quite easily with the improved release mechanism of this invention and the unit will withstand the opening shock of such a force.

The solenoid 18 is supported on a frame 19 which is suitably secured by screws 21 within the space 10D defined in the frame 10. FIG. 7 shows the electrical lines 75 coupling to the solenoid 18 for selective operation thereof. When the solenoid 18 is operated the plunger 72 pulls the release plate 48 upwardly as viewed in FIG. 7 permitting the latch bar 16 to rotate to the position shown in phantom in FIG. 7. This action releases the pin 64 and its associated bushing from the latch 50 and the vent is thus able to open to its open position as shown in FIG. 1.

FIGS. 11 and 12 show the alternate embodiment for actuating the release bar. In FIGS. 11 and 12 like reference characters will be used in describing parts previously described with reference to FIGS. 1–10. The latch bar 16 is held in its latched position as shown in FIGS. 11 and 12 by the release plate 48. The release plate 48 is pinned to an operating shaft 80 which couples to the air cylinder 82. FIG. 11 shows the pair of air cylinders 82 disposed on opposite sides of the vent and associated air lines 83 interconnected by means of coupling 84 to an air supply not shown in the drawings. When air is applied to the cylinder 82 the cylinder rod 80 extends as shown in FIG. 12. When air is released an internal spring (not shown) retracts the cylinder rod pulling the latch bar release 48 and allowing the latch bar 16 to release.

Having described a limited number of embodiments of the present invention, it should now become apparent to those skilled in the art that there are numerous other embodiments and modifications of the ones shown herein all of which are contemplated as falling within the spirit and scope of the present invention as defined by the appended claims.

What is claimed is:

1. A vent for a building comprising;

a fixed frame, a movable frame adapted to close against the fixed frame when in a closed position, a panel means for insertion into the movable frame, means for pivotally securing said movable frame to said fixed frame, means for urging said movable frame to an open position, means on said fixed and movable frames for limiting the open position of said movable frame, latch means for maintaining said movable frame in the closed position including a latch member, means for pivotally securing the latch member to one of said frames, an elongated latch bar member having base means at one end including means for pivotally securing the latch bar member to the other frame and pin means supported by said base means and disposed between the pivotal securing means of said latch member and the latch bar member, respectively, and means for urging said latch member to a dwell position, and means for releasing said latch means to permit said movable frame to move to its open position including release means which in one position maintains another end of said latch bar member in a locked closed position and means for moving said release means to thereby disengage from said latch bar member permitting said latch bar member to pivot so that said latch member can disengage from said pin means to enable opening of the movable frame, said latch bar member, when in its locked position, being disposed substantially parallel to said panel means with the axis of said pin means being disposed, in the longitudinal direction of the latch bar member, spaced from the axis of the latch bar member pivot and disposed between the latch bar member pivot and said another end of said latch bar member.

2. A vent as set forth in claim 1 wherein the length of said latch bar member is at least an order of magnitude greater than said distance taken in the said longitudinal direction between the axis, the pin means and the axis of the latch bar member pivot.

3. A vent as set forth in claim 1 wherein said panel means comprises a pair of panels and support means for the panels in the movable frame.

4. A vent as set forth in claim 3 including peripheral clip means for holding the support means and in turn the panels in place.

5. A vent as set forth in claim 1 wherein said means for pivotally securing is secured at the bottom of the frames.

6. A vent as set forth in claim 1 wherein said means for limiting includes a pair of shock absorbers disposed one on each side of the frames.

7. A vent as set forth in claim 1 wherein said latch member is secured to the movable frame and said latch bar member is secured to the fixed frame.

8. A vent as set forth in claim 7 wherien said latch member comprises a hook member .

9. A vent as set forth in claim 8 wherein said means for urging includes spring means supported from the latch member for rotatably urging the latch member into engaging position with the latch bar member pin means.

10. A vent as set forth in claim 9 including means for adjustably varying the position of the latch member.

11. A vent as set forth in claim 7 wherein said latch bar member includes a base pivotally secured to the fixed frame and having spaced walls between which the pin extends for engagement with the latch member.

12. A vent as set forth in claim 11 wherein said pin is offset from the pivot of the latch bar base to provide an eccentric action.

13. A vent as set forth in claim 11 wherein said latch bar member also includes an elongated bar extending from the base.

14. A vent as set forth in claim 13 wherein said means for releasing includes an air cylinder connected to a release plate for holding the end of the bar in a closed position.

15. A vent for a building comprising;

a fixed frame, a moveable frame adapted to close against the fixed frame when in a closed position, a panel means for insertion into the moveable frame, means for pivotally securing said moveable frame to said fixed frame, means for urging said moveable frame to an open position, means on said fixed and moveable frames for limiting the open position of said moveable frame, latch means for maintaining said moveable frame in the closed position including a latch member pivotally secured to the moveable frame and a latch bar member pivotally secured to the fixed frame and including a base pivotally secured to the fixed frame and having extending from the base an elongated arm extending in its locked position substantially parallel to said panel means, and pin means also supported by the latch bar member base, said pin means being disposed between the latch member pivot and the latch bar member pivot, and means for releasing said latch means to permit said moveable frame to move to its open position including release means which in one position maintains another end of the latch bar member in a locked closed position and means for moving said release means to thereby disengage from said latch bar member permitting said latch bar member to pivot so that said latch member can disengage from said pin means to enable opening of the moveable frame, said release means including remotely operated means engaging a free end of the elongated arm and moveable in a direction parallel to said panel means and in line with said arm to enable disengagement of the arm therefrom and pivoting thereof to disengage the pin means from the latch member.

* * * * *